United States Patent [19]

Wombacher

[11] Patent Number: 4,724,968

[45] Date of Patent: Feb. 16, 1988

[54] DEVICE FOR THE PRESENTATION OF RETAIL ARTICLES

[75] Inventor: Ulrich Wombacher, Duesseldorf, Fed. Rep. of Germany

[73] Assignee: Henkel Kommanditgesellschaft auf Aktien, Duesseldorf, Fed. Rep. of Germany

[21] Appl. No.: 930,189

[22] Filed: Nov. 13, 1986

[30] Foreign Application Priority Data

Nov. 16, 1985 [DE] Fed. Rep. of Germany ..... 3540735

[51] Int. Cl.[4] ..... A47F 7/00

[52] U.S. Cl. ..... 211/59.3; 211/43; 211/184

[58] Field of Search ..... 211/43, 184, 51, 59.3, 211/189; 108/61

[56] References Cited

U.S. PATENT DOCUMENTS 2,516,122 7/1950 Hughes ..... 108/61 X
2,652,154 9/1953 Stevens ..... 211/43 X
4,460,096 7/1984 Ricci ..... 211/184
4,488,653 12/1984 Belokin ..... 211/184

FOREIGN PATENT DOCUMENTS 394537 11/1965 Switzerland ..... 211/43

*Primary Examiner*—Ramon S. Britts
*Assistant Examiner*—Blair Johnson
*Attorney, Agent, or Firm*—Ernest G. Szoke; Henry E. Millson, Jr.; Real J. Grandmaison

[57] ABSTRACT

In a device formed with at least one fixed lateral flange, more especially a shelf insert, for the presentation of retail articles, the device provides for economical, material-saving production and for simple adaptation to different retail article widths.

The device comprises two baseplates releasably interconnected by a head piece with supporting surfaces for the product, the inner mutually opposite longitudinal edges of the baseplates being spaced apart from one another and the width of the head piece substantially corresponding to the width of the particular retail article to be presented.

18 Claims, 3 Drawing Figures

DEVICE FOR THE PRESENTATION OF RETAIL ARTICLES

BACKGROUND OF THE INVENTION

1. Field of the Invention

This invention relates to a device comprising a shelf insert for the presentation of retail articles.

2. Statement of Related Art

Various devices of the type herein are known from the prior art. However, all these known devices comprise continuous or interconnectible baseplates of which the width corresponds to that of the retail article to be presented or to a multiple thereof.

The disadvantage of these known devices is that their manufacture is highly material-intensive on account of the solid baseplate and that a separate shelf insert has to be made and stocked for each pack width of retail articles to be presented in such a shelf insert. This involves high material, production and storage costs for, in some cases, very small production runs.

Accordingly, it is an object of the present invention to provide a solution which provides for materialsaving, economic production of devices of the afore-mentioned type, and for simple adaptation to different retail article widths.

DESCRIPTION OF THE INVENTION

In accordance with the invention, this object is achieved by a device comprising two baseplates which are releasably interconnected by a head piece having supporting surfaces for the product, the inner mutually opposite lonitudinal edges of the baseplates being spaced apart from one another, and wherein the width of the head piece substantially corresponds to the width of the particular retail article to be presented.

A particular advantage of the device according to the invention is that only two relatively narrow baseplates and one head piece substantially corresponding to the width of the product to be disclosed are required for forming a shelf insert. The two baseplates are kept apart by the head piece so that there is no longer any need for a continuous, material-intensive baseplate. The two baseplates are universally useable because they are releasably interconnected by a head piece. To form a shelf insert, a head piece corresponding to the particular width of the retail article to be presented merely has to be arranged for frontal connection on the two baseplates. By changing the head piece, the device according to the invention may rapidly be adapted to different pack widths.

In addition to material savings, the device according to the invention also reduces production costs because, in view of the universal useability of the baseplates for different pack or retail article widths, it is now merely necessary to produce head pieces of different widths and no longer complete shelf inserts.

These advantages have a particularly favorable effect when the combined individual widths of the baseplates are smaller than the width of the head piece.

In one particular embodiment of the invention, the front plate of the head piece does not project significantly beyond the lower portion of the guide elements of the baseplates. The advantage of this is that, where the device according to the invention is used as a shelf insert, a scanner-readable price bar, for example, may be arranged directly beneath the head piece on the shelf base without being covered by the head piece of the device according to the invention in the use position.

A further saving of material, which is particularly relevant where several shelf inserts are joined together and which nevertheless affords the retail articles to be presented on the device with adequate protection against lateral shifting, is obtained where only one baseplate has an integrally formed lateral flange.

In order to establish a stable but releasable connection between the baseplates and the head piece, it is appropriate and advisable to provide guide and/or retaining elements arranged on the baseplates to receive the head piece and corresponding cooperating elements on the head piece.

In another embodiment of the invention, a displaceable supporting element located at the rear portion of the device is present between the baseplates. This supporting element may readily be arranged between the baseplates with the same or at least similar guide elements as for the head piece and effectively presents the retail articles from dropping out rearwards, particularly during the filling of the shelf inserts.

Another embodiment of the invention is characterized in that a drawing-in element is arranged between the head piece and the supporting element. By means of this drawing-in element, the rear end supporting element is easily and effectively drawn frontwards into the vicinity of the head piece when there are no longer any retail articles present between the head piece and the supporting element or, alternatively, is guided frontwards so that it bears flush against the back of the rearmost retail article. If finally the supporting element is situated at the front of the device in the vicinity of the head piece, this is a visual sign that the corresponding shelf insert needs refilling with retail articles. Otherwise, the supporting element ensures that retail articles situated one behind the other on the shelf insert are transported flush into the vicinity of the head piece.

Finally, another embodiment of the invention is characterized by the provision of a stabilizing element arranged on the bottom portion of the baseplates and which connects the baseplates. This stabilizing element prevents the baseplates from spreading apart towards the rear of the shelf insert and facilitates assembly in the region of shelf boards.

BRIEF DESCRIPTION OF THE DRAWINGS

The invention is described by way of illustration in the following with reference to the accompanying drawings, wherein.

DETAILED DESCRIPTION OF THE DRAWINGS

Figure 1:
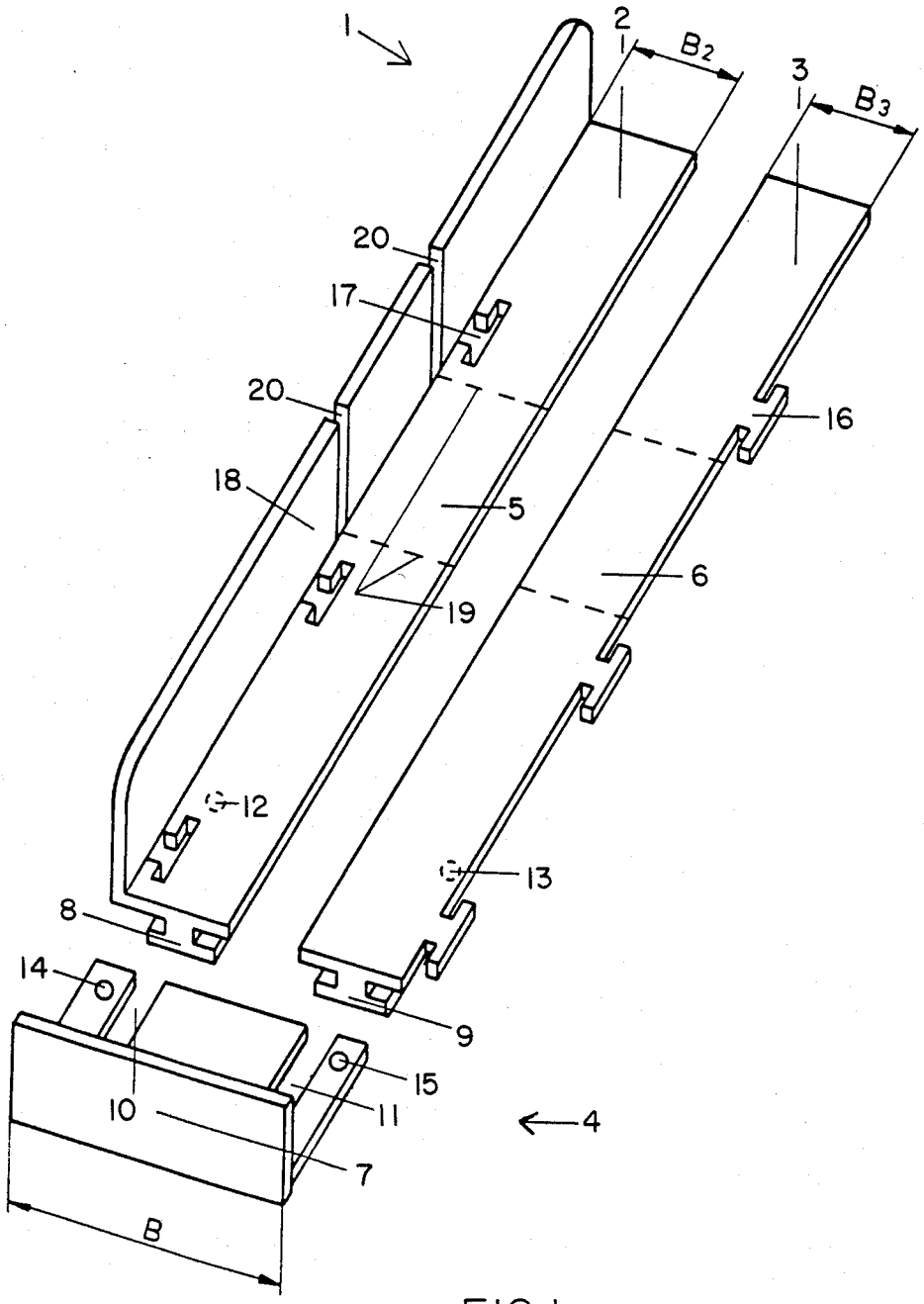
FIG. 1 is a plan view of a shelf insert before assembly.

The device generally denoted by the reference 1 in FIG. 1 consists of two baseplates 2 and 3 and a head piece 4. The width B of head piece 4 substantially corresponds to the width of the retail article to be displayed on the product supporting surfaces 5 and 6 of the baseplates 2 and 3 and is greater than the added individual widths $B_2$ and $B_3$ of the baseplates 2 and 3. For example, the widths $B_2$ and $B_3$ may each be 20 mm for retail articles from 55 to 130 mm wide.

On the head side, the head piece 4 is retained between the baseplates 2 and 3 and keeps them at such a distance apart that the retail articles to be displayed rest at least at their edges on the product supporting surfaces 5 and 6 of the baseplates 2 and 3.

To receive and guide the head piece 4, the baseplates 2 and 3 comprise guide elements 8 and 9 in the form of T-profiles formed substantially centrally on the underside of baseplates 2 and 3. Cooperating elements 10 and 11 in the form of slots are correspondingly provided on the head piece 4. To hold the head piece 4 on the baseplates 2 and 3, projections 12 and 13 are formed as retaining elements on the bottom side or underneath of the baseplates, engaging in corresponding openings 14 and 15 provided as corresponding counter-elements in the head piece 4 after the head piece 4 has been inserted between the two baseplates 2 and 3.

Arranged on the head piece 4 is a front plate 7 which extends substantially above the produce supporting surfaces 5 and 6 of the baseplates 2 and 3 but which does not project far beyond the lower side or underneath of the guide elements 8 and 9 in the downward direction.

To enable several devices 1 to be joined laterally to one another, the baseplate 3 is formed with integral laterally projecting dovetail-like connecting elements 16 which, on assembly, engage in corresponding openings 17 in the baseplate 2. In order to afford the retail articles to be displayed on the device 1 with protection against lateral shifting, the baseplate 2 is formed on its outside edge at a right-angle with a fixed lateral flange 18.

To enable the device 1, where it is used as a shelf insert, to be adapted to different shelf board depths, the baseplates 2 and 3 and the lateral flange 18 are provided with predetermined break lines 19 and notches 20, respectively.

Figure 2:
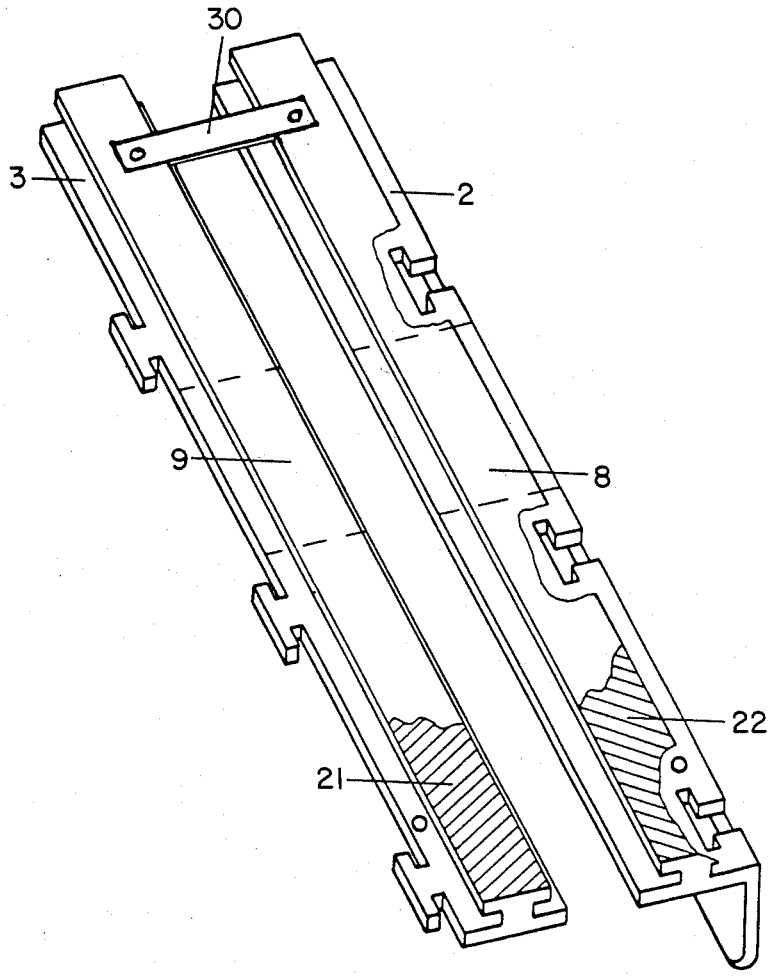
FIG. 2 is a view from beneath of two baseplates with a stabilizing element arranged thereon.

FIG. 2 shows the bottom side or underneath of the two baseplates 2 and 3 with the guide elements 8 and 9 formed integrally thereon. For fixing the baseplates 2 and 3 as a shelf insert in the in-use position on shelf boards, the surface of the T-profiles 8 and 9 comprises a continuous layer 21 and 22, respectively, of adhesive (shown in part only) in the vicinity of the horizontal bar of the T-shaped guide elements 8 and 9.

Figure 3:
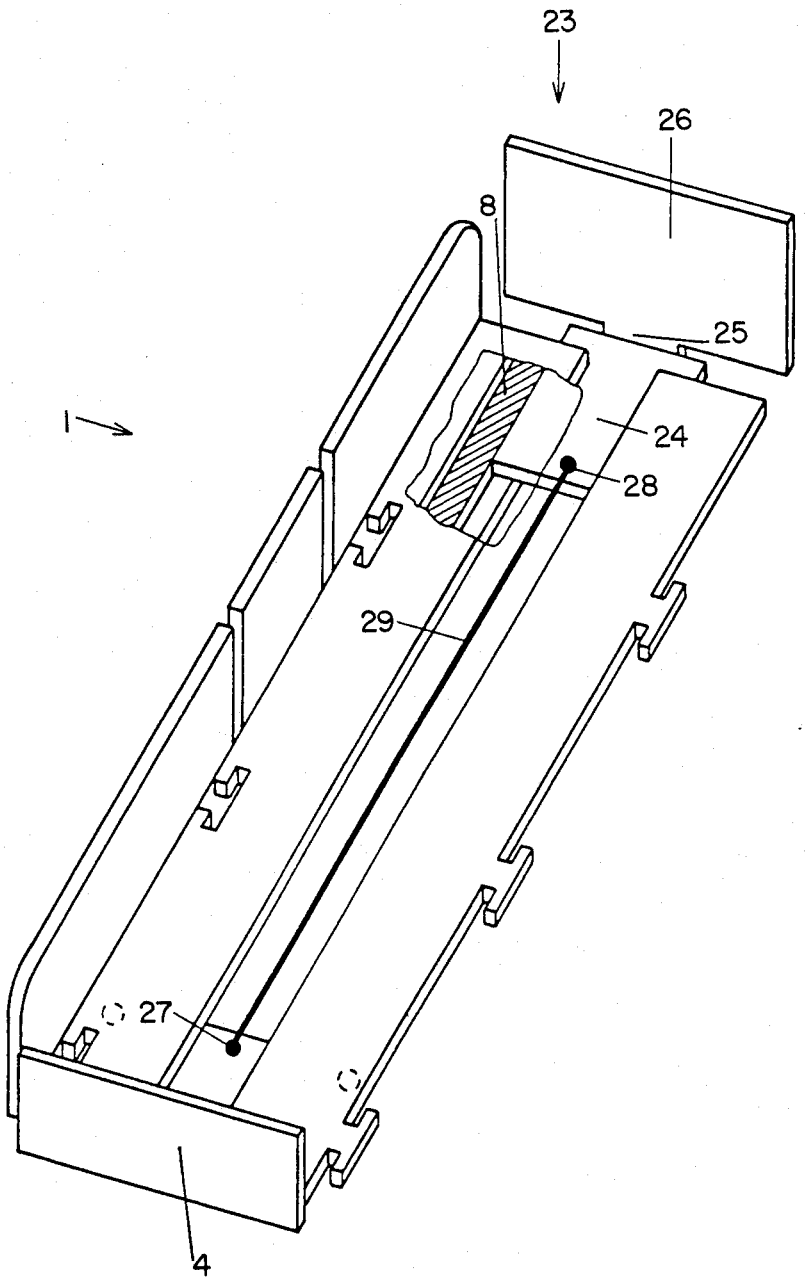
FIG. 3 shows an assembled shelf insert with a supporting element and drawing-in element.

As shown in FIG. 3 for the guide element 8, the T-shaped guide elements 8 and 9 are also guide elements for a supporting element 23 inserted into the device 1 from the rear end of the device 1. In the embodiment illustrated, the guide element 23 is a polystyrene angled element which is bevelled at substantially a right angle and which is guided between the T-shaped guide elements 8 and 9 by a guide surface 24 spanning the gap between the two baseplates 2 and 3, between the two baseplates 2 and 3 by a flange element 25, and above the product supporting surfaces 5 and 6 by a supporting surface 26 which extends across the entire product supporting surfaces. Eyes 27 and 28 for receiving a drawing-in element 29 are arranged in the middle portion of the guide surface 24 and the middle portion of the head piece 4, respectively, on their mutually opposite sides. This drawing-in element 29 ensures that the supporting element 23 is drawn into the vicinity of the head piece according to the number of retail articles on the product supporting surfaces in such a way that it always bears against the last retail article or, in the absence of retail articles on the product supporting surfaces, virtually abuts the head piece 4. The drawing-in element 29 may be, for example, a helical spring or a rubber band.

A stabilizing element 30 shown in FIG. 2 joining the two baseplates 2 and 3 is arranged on the underneath thereof in the region remote from the head piece 4, i.e., near the rear portion of the device 1.

The preferred material for the device 1 is polystyrene, particularly transparent polystyrene. However, the device may also be made of other plastics and materials.

The embodiment described by way of example in the foregoing may of course be modified in many respects within the scope of the invention. Thus, the retaining elements 12 and 13 and the cooperating elements 14 and 15 may also be formed by clips, press studs, velcro strip or adhesive tape fastenings. In addition, the guide elements 8 and 9 need not be T-shaped as illustrated, instead they may have an L-shaped cross-section or may be integrally formed as a straight flange on the baseplates 2 and 3. Neither are the widths of the baseplates 2 and 3 confined to the dimensions cited above. The widths $B_2$ and $B_3$ may each be up to 20 cm.

Nor is there any need for the guide elements 8 and 9 to extend over the entire length of the baseplates 2 and 3, as shown in FIG. 2. For example, they may also be integrally formed in partial zones, at the head piece and in the vicinity of the predetermined break lines 19 and also differently, for example as a T-profile in the head portion and as an L-profile in the rear portion for guiding the supporting element 23.

Similarly, the adhesive layers 21 and 22 do not have to extend over the entire length of the guide elements. Instead, individual adhesive spots may also be applied, for example from a two-sided adhesive film.

I claim:

1. A device useful as a shelf insert for displaying retail articles, said device comprising two baseplates releasably interconnected by a head piece, and having a displaceable supporting element located between said baseplates at the rear portion of said device, said baseplates having supporting surfaces for said articles wherein said baseplates are spaced and kept apart from one another by said head piece and said supporting element, said head piece determining the width of said device wherein the width of said head piece substantially corresponds to the width of said articles to be displayed on said baseplates, said baseplates having guide element and at least one retaining element formed underneath said supporting surfaces for interconnection with said head piece, said head piece having slots therein which engage the innerted T-shaped guide elements and openings which engage the retaining elements.

2. A device as in claim 1 wherein the combined individual widths of said baseplates are smaller than the width of said head piece.

3. A device as in claim 1 wherein said head piece is provided with a front plate which projects substantially above said supporting surfaces of said baseplate but does not project significantly beyond the lower portion of said baseplates.

4. A device as in claim 1 wherein one of said baseplates is provided with a fixed lateral flange.

5. A device as in claim 1 wherein a drawing-in element is arranged between said head piece and said supporting element.

6. A device as in claim 5 wherein said drawing-in element comprises a spring.

7. A device as in claim 5 wherein said drawing-in element comprises a rubber band.

8. A device as in claim 1 including a stabilizing element arranged on the bottom portion of said baseplates and which connects said baseplates.

9. A device for the presentation of retail articles comprising an elongate shelf insert having a freely accessible product supporting surface which is divided by a gap longitudinally dividing said shelf insert into two parts, said product supporting surface comprising two baseplates wherein one of said baseplates is formed with at least one fixed lateral flange, said shelf insert further comprising a head piece releasably interconnected with said baseplates in a manner to keep said two parts of said product supporting surface at a fixed distance apart, said head piece having a width which substantially corresponds to the width of said retail articles, said shelf insert further comprising a displaceable supporting element located between said baseplates at the rear portion of said shelf insert, and wherein said baseplates each have at least one inverted T-shaped guide element and at least one retaining element formed underneath said supporting surface for interconnection with said head piece, said head piece having slots therein which engage the guide elements and openings which engage the retaining elements.

10. A device as in claim 9 wherein the combined individual widths of said baseplates are smaller than the width of said head piece.

11. A device as in claim 9 wherein said head piece is provided with a front plate which extends substantially above said product supporting surface and which does not project significantly beyond the lower portion of said baseplates.

12. A device as in claim 9 wherein a drawing-in element is arranged between said head piece and said supporting element.

13. A device as in claim 12 wherein said drawing-in element comprises a spring.

14. A device as in claim 12 wherein said drawing-in element comprises a rubber band.

15. A device as in claim 9 including a stabilizing element arranged on the bottom portion of said baseplates and which connects said baseplates.

16. A device as in claim 9 wherein one of said baseplates is integrally formed with laterally projecting connecting elements and the other of said baseplates is formed with corresponding openings for joining together said baseplates.

17. A device as in claim 9 wherein said baseplates are provided with predetermined break lines and said lateral flange is provided with notches.

18. A device as in claim 9 wherein at least a portion of the bottom surface of said baseplates is provided with an adhesive.

* * * * *